US006179573B1

(12) United States Patent
Hablanian

(10) Patent No.: US 6,179,573 B1
(45) Date of Patent: Jan. 30, 2001

(54) VACUUM PUMP WITH INVERTED MOTOR

(75) Inventor: Marsbed Hablanian, Wellesley, MA (US)

(73) Assignee: Varian, Inc., Palo Alto, CA (US)

( * ) Notice: Under 35 U.S.C. 154(b), the term of this patent shall be extended for 0 days.

(21) Appl. No.: 09/275,732

(22) Filed: Mar. 24, 1999

(51) Int. Cl.[7] ..... F04B 3/00
(52) U.S. Cl. ..... 417/244; 415/90
(58) Field of Search ..... 417/244, 423.1; 415/90, 55.3, 55.6

(56) References Cited

U.S. PATENT DOCUMENTS

| | | | | |
|---|---|---|---|---|
| 4,732,530 | * | 3/1988 | Ueda et al. | 415/90 |
| 4,735,550 | * | 4/1988 | Okawada et al. | 415/55.6 |
| 5,020,969 | * | 6/1991 | Mase et al. | 415/55.3 |
| 5,052,887 | * | 10/1991 | Noviko et al. | 415/90 |
| 5,238,362 | | 8/1993 | Casaro et al. . | |
| 5,324,177 | * | 6/1994 | Golding et al. | 417/423.1 |
| 5,370,509 | * | 12/1994 | Golding et al. | 417/423.1 |
| 5,611,660 | * | 3/1997 | Wong et al. | 415/90 |

FOREIGN PATENT DOCUMENTS 3919529 1/1990 (DE) .

OTHER PUBLICATIONS

U.S. application No. 09/310,498, Casaro et al., filed May 12, 1999.

* cited by examiner

*Primary Examiner*—Teresa Walberg
*Assistant Examiner*—Quang Van
(74) *Attorney, Agent, or Firm*—Bella Fishman

(57) ABSTRACT

A vacuum pump includes a housing having an inlet port and an exhaust port, a motor disposed in the housing, and one or more vacuum pumping stages disposed in the housing and operationally coupled to the motor for pumping gas from the inlet port to the exhaust port. The motor includes a stator disposed on a central axis and a rotor disposed around the stator. The rotor rotates about the central axis when the motor is energized. The motor may be located at the center of the housing, and the vacuum pumping stages may be disposed around the motor in an annular configuration. The inverted motor configuration facilitates a compact vacuum pump structure.

10 Claims, 4 Drawing Sheets

VACUUM PUMP WITH INVERTED MOTOR

FIELD OF THE INVENTION

This invention relates to high vacuum pumps used for evacuating an enclosed vacuum chamber and, more particularly, to compact vacuum pump structures. The invention relates to vacuum pumps of the type which incorporate an electrical motor, such as for example turbomolecular pumps, molecular drag pumps and hybrid pumps.

BACKGROUND OF THE INVENTION

Conventional turbomolecular vacuum pumps include a housing having an inlet port, an interior chamber containing a plurality of axial pumping stages and an exhaust port. The exhaust port is typically attached to a roughing vacuum pump. Each axial pumping stage includes a stator having inclined blades and a rotor having inclined blades. The rotor and stator blades are inclined in opposite directions. The rotor blades are rotated at high speed by a motor to pump gas between the inlet port and the exhaust port. A typical turbomolecular vacuum pump may include nine to twelve axial pumping stages.

Variations of the conventional turbomolecular vacuum pump are known in the art. In one prior art configuration, one or more of the axial pumping stages are replaced with disks which rotate at high speed and function as molecular drag stages. This configuration is disclosed in U.S. Pat. No. 5,238,362 issued Aug. 24, 1993 to Casaro et al. A turbomolecular vacuum pump including an axial turbomolecular compressor and a molecular drag compressor in a common housing is sold by Varian Associates, Inc. under Model No. 969-9007. Turbomolecular vacuum pumps utilizing molecular drag disks and regenerative impellers are disclosed in German Patent No. 3,919,529 published Jan. 18, 1990.

Molecular drag compressors include a rotating disk and a stator. The stator defines a tangential flow channel and an inlet and an outlet for the tangential flow channel. A stationary baffle, often called a stripper, disposed in the tangential flow channel separates the inlet and the outlet. As is known in the art, the momentum of the rotating disk is transferred to gas molecules within the tangential flow channel, thereby directing the molecules toward the outlet.

Another type of molecular drag compressor includes a cylindrical drum that rotates within a housing having a cylindrical interior wall in close proximity to the rotating drum. The outer surface of the cylindrical drum is provided with a helical groove. As the drum rotates, gas is pumped through the groove by molecular drag.

A prior art high vacuum pump is shown in FIG. 4. A housing 10 defines an interior chamber 12 having an inlet port 14 and an exhaust port 16. The housing 10 includes a vacuum flange 18 for sealing the inlet port to a vacuum chamber (not shown) to be evacuated. The exhaust port 16 is typically connected to a roughing vacuum pump (not shown). In cases where the vacuum pump is capable of exhausting to atmospheric pressure, the roughing pump is not required. Located within housing 10 is an axial turbomolecular compressor 20, which typically includes several axial turbomolecular stages, and a molecular drag compressor 22, which typically includes several molecular drag stages. Each stage of the axial turbomolecular compressor 20 includes a rotor 24 and a stator 26. Each rotor and stator has inclined blades as is known in the art. Each stage of the molecular drag compressor 22 includes a rotor disk 30 and a stator 32. The rotor 24 of each turbomolecular stage and the rotor 30 of each molecular drag stage are attached to a drive shaft 34. The drive shaft 34 is rotated at high speed by a motor located in a motor housing 38.

Turbomolecular vacuum pumps and related types of vacuum pumps are used in a wide variety of applications. In many applications, the physical size of the vacuum pump is an important system design consideration. For example, vacuum pumps are frequently used in semiconductor processing equipment that is located in or adjacent to clean room facilities. In such applications, strict limitations are placed on the size of the equipment. Another application requiring small size is portable instruments. Referring again to FIG. 4, it may be observed that the motor housing 38 accounts for a significant fraction of the overall length of the vacuum pump.

Accordingly, there is a need for vacuum pump structures which are compact and which are simple to manufacture.

SUMMARY OF THE INVENTION

According to a first aspect of the invention, a vacuum pump is provided. The vacuum pump comprises a housing having an inlet port and an exhaust port, a motor disposed in the housing, and one or more vacuum pumping stages disposed in the housing and operationally coupled to the motor for pumping gas from the inlet port to the exhaust port. The motor has an inverted configuration wherein a stator is disposed on a central axis and a rotor is disposed around the stator. The rotor rotates about the central axis when the motor is energized.

At least part of the motor may be located in a central portion of the vacuum pumping stages, so that the vacuum pumping stages have an annular configuration disposed around the motor. The vacuum pumping stages may be located between the rotor and the housing, thereby achieving a compact vacuum pump structure.

Each of the vacuum pumping stages may comprise a stationary member secured to the housing and a rotating member secured to the rotor of the motor. In a first embodiment, one or more of the vacuum pumping stages comprises an axial turbomolecular pumping stage, each including a stationary member having inclined blades and a rotating member having inclined blades. In a second embodiment, one or more of the vacuum pumping stages comprises a molecular drag stage, each including a stationary member having a tangential flow channel and a rotating member in the form of a disk. In a third embodiment, one or more of the vacuum pumping stages comprises a rotating member and a stationary member disposed in close proximity, one of the members having a molecular drag groove for pumping gas when the rotating member rotates relative to the stationary member.

In another embodiment, the vacuum pumping stages comprise at least one outer stage located between the rotor and the housing, and at least one inner stage located between the rotor and the stator, wherein the outer stage and the inner stage are connected in series.

The stator of the motor may comprise a central post having motor windings disposed thereon. The rotor may comprise a cylindrical element disposed around the stator. The cylindrical element has magnetic material located in alignment with the motor windings.

According to another aspect of the invention, a vacuum pump comprises a housing having an inlet port and an exhaust port, a motor disposed in the housing and a vacuum pumping stage. The motor comprises a stator and a rotor that rotates about a central axis when the motor is energized. The stator has a stator surface, and the rotor has a rotor surface that is spaced from the stator surface by a small gap. The vacuum pumping stage comprises a molecular drag groove disposed on the stator surface or the rotor surface. Gas is pumped through the molecular drag groove from the inlet port to the exhaust port when the motor is energized. The motor may have an inverted or a non-inverted configuration.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
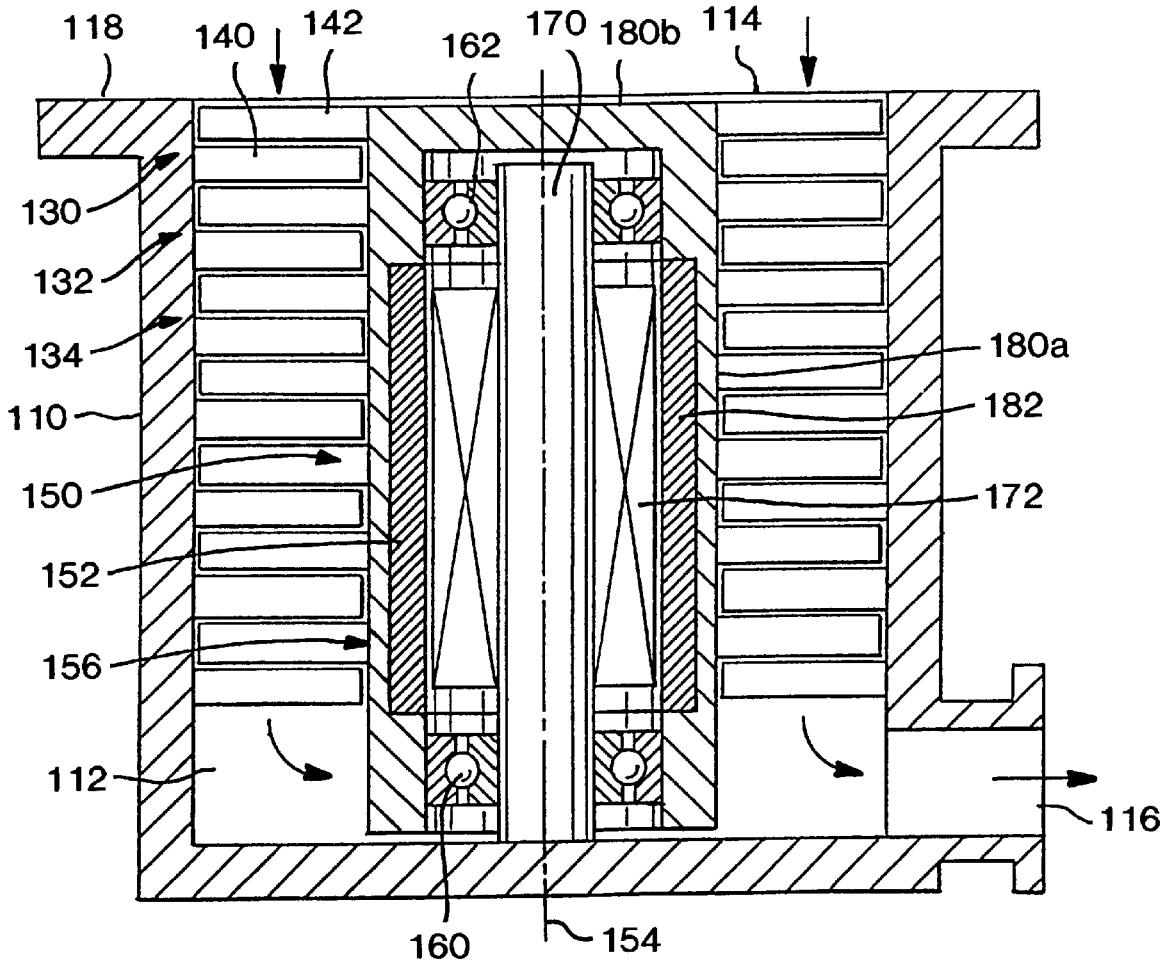
FIG. 1 is a simplified cross-sectional diagram of a vacuum pump in accordance with a first embodiment of the invention.

A simplified cross-sectional diagram of a high vacuum pump in accordance with a first embodiment of the invention is shown in FIG. 1. A housing 110 defines an interior chamber 112 having an inlet port 114 and an exhaust port 116. The housing 110 includes a vacuum flange 118 for sealing the inlet port 114 to a vacuum chamber (not shown) to be evacuated. The exhaust port 116 may be connected to a roughing vacuum pump (not shown). In cases where the vacuum pump is capable of exhausting to atmospheric pressure, the roughing pump is not required.

Located within housing 110 are one or more vacuum pumping stages 130, 132, 134, etc. Typically, the vacuum pump includes several vacuum pumping stages. Each vacuum pumping stage includes a stationary member 140 and a rotating member 142. As described below, the vacuum pumping stages may be implemented as axial turbomolecular stages, molecular drag stages or combinations thereof.

The vacuum pump shown in FIG. 1 includes a motor 150 positioned within housing 110. According to a feature of the invention, motor 150 has an inverted configuration as compared with conventional motors. In particular, motor 150 includes a stator 152 positioned on a central axis 154 and a rotor 156 disposed around stator 152. Rotor 156 is mounted to stator 152 with bearings 160 and 162 to permit rotation of rotor 156 about central axis 154.

Stator 152 includes a central post 170 and a motor winding 172 disposed on central post 170. Central post 170 is located on central axis 154 and is rigidly attached to housing 110. Rotor 156 may have an inverted cup-shaped configuration including a cylindrical wall 180*a* and an end wall 180*b*. Magnetic material 182 is located in cylindrical wall 180*a* in alignment with and surrounding motor winding 172. When motor 150 is energized, an electrical current is supplied to motor winding 172. As known to those skilled in the electric motor art, interactions between the magnetic fields produced by motor winding 172 and the magnetic fields produced by magnetic material 182 cause rotor 156 to rotate about central axis 154.

Motor 150 has an inverted configuration as compared with conventional motors. In particular, conventional motors have a stator surrounding a rotor located on a central axis, whereas the motor 150 has rotor 156 surrounding stator 152. The inverted motor configuration is advantageous with respect to construction of a compact vacuum pump. As shown in FIG. 1, the rotating member 142 of each vacuum pumping stage 130, 132, 134, etc. may be mounted on rotor 156 of motor 150. The stationary member 140 of each vacuum pumping stage 130, 132, 134, etc. may be secured to housing 110. More particularly, the inverted motor configuration permits the motor 150 to be located in the central portion of the vacuum pump, surrounded by the vacuum pumping stages. As a result, the length added to the vacuum pump by mounting a motor on one end thereof is eliminated, and a compact vacuum pump structure is achieved. The inverted motor configuration is particularly advantageous in small vacuum pumps where a conventional non-inverted motor does not fit inside the vacuum pumping stages.

Each of vacuum pumping stages 130, 132, 134, etc. may be any type of vacuum pumping stage that is driven by a motor. In a first example, the vacuum pumping stages are axial turbomolecular stages. Each axial turbomolecular stage includes a rotating member and a stationary member. Each rotating member and each stationary member has inclined blades, with the blades of the rotating and stationary members being inclined in opposite directions. The blades of the rotating members are rotated at high speed to pump gas. The construction of axial turbomolecular stages is well known to those skilled in the vacuum pump art.

In a second example, each of the vacuum pumping stages 130, 132, 134, etc. may comprise a molecular drag stage, which includes a rotating disk and a stationary member. The stationary member is provided with one or more tangential flow channels. Each tangential flow channel has an inlet and an outlet separated by a stationary baffle. When the rotating disk is rotated at high speed, gas is pumped through the tangential flow channel by molecular drag produced by the rotating disk.

In a third example, the vacuum pump includes a molecular drag compressor wherein the rotating member comprises a cylindrical drum and the stationary member has a cylindrical interior wall in closely-spaced relationship to the cylindrical drum. The rotating member may be provided with a helical groove on its outer surface. As the drum is rotated, gas is pumped through the groove by molecular drag.

In a fourth example, the vacuum pump includes a combination of two or more types of vacuum pumping stages. For example, the vacuum pump may include one or more axial turbomolecular stages and one or more molecular drag stages. In each case, the rotating member of each vacuum pumping stage is attached to the rotor 156 of motor 150.

An advantage of the vacuum pump structure shown in FIG. 1 and described above is that the vacuum pump is very compact. The pump length may be limited to the length required for the vacuum pumping stages. The motor is located centrally inside the vacuum pumping stages. The inverted motor configuration is particularly advantageous in small vacuum pumps where a conventional non-inverted motor does not fit inside the vacuum pumping stages.

Another advantage is the simplicity of isolating the electromagnetic driver from contact with the pumped gas. This can protect the windings from corrosive effects and can protect the high vacuum environment from outgassing which emanates from the windings. The center part of the pump can be more easily isolated and kept in a pressure environment which provides improved heat transfer for cooling the motor windings.

Figure 2:
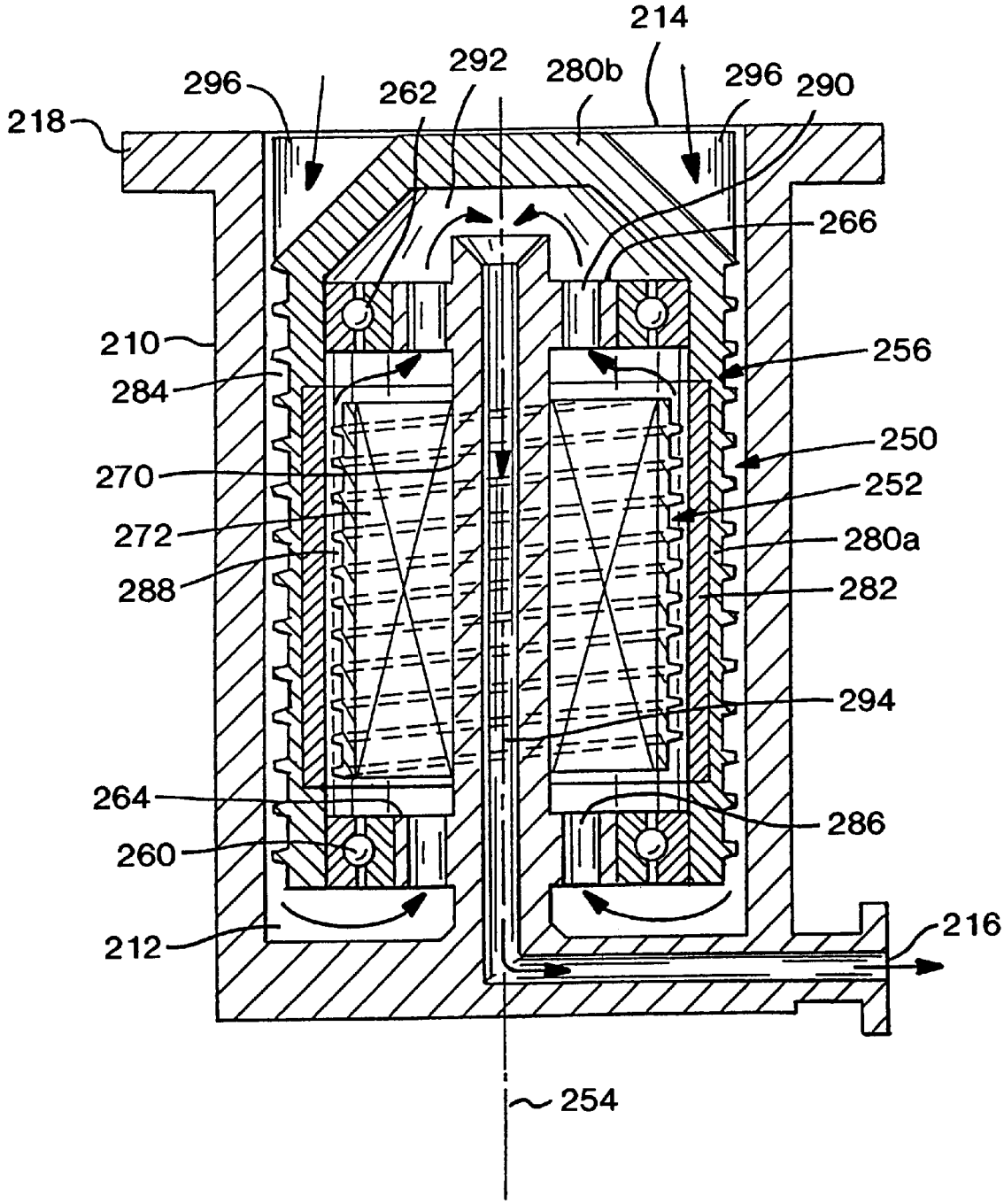
FIG. 2 is a simplified cross-sectional diagram of a vacuum pump in accordance with a second embodiment of the invention.

A simplified cross-sectional diagram of a high vacuum pump in accordance with a second embodiment of the invention is shown in FIG. 2. A housing 210 defines an interior chamber 212 having an inlet port 214 and an exhaust port 216. The housing 210 includes a vacuum flange 218 for sealing the inlet port 214 to a vacuum chamber (not shown) to be evacuated. The exhaust port 216 may be connected to a roughing vacuum pump (not shown) or may exhaust to atmospheric pressure. The vacuum pump shown in FIG. 2 includes a motor 250 positioned within housing 210. Motor 250 has an inverted configuration. In particular, motor 250 includes a stator 252 positioned on a central axis 254 and a rotor 256 disposed around stator 252. Rotor 256 is mounted to stator 252 using bearings 260 and 262 to permit rotation of rotor 256 about central axis 254.

Stator 252 includes a central post 270 and a motor winding 272 disposed on central post 270. Central post 270 is located on central axis 254 and is rigidly attached to housing 210. Stator 252 further includes a lower plate 264 for mounting of bearing 260 and an upper plate 266 for mounting of bearing 262. Rotor 256 may have an inverted cup-shaped configuration including a cylindrical wall 280*a* and an end wall 280*b*. Magnetic material 282 is located in cylindrical wall 280*a* in alignment with and surrounding motor winding 272. When motor 250 is energized, an electrical current is supplied to motor winding 272. Interactions between the magnetic fields produced by motor winding 272 and the magnetic fields produced by magnetic material 282 to cause rotor 256 to rotate about central axis 254.

The vacuum pump shown in FIG. 2 may include one or more vacuum pumping stages between rotor 256 and housing 210 and may additionally include one or more vacuum pumping stages between rotor 256 and stator 252 of motor 250. In the embodiment of FIG. 2, rotor 256 has a generally cylindrical outer wall, and housing 210 has a generally cylindrical inner wall in close proximity to rotor 256. The outer wall of rotor 256 is provided with a molecular drag groove 284, which may have a helical configuration, for molecular drag pumping.

A space within housing 210 at the lower end of rotor 256 is coupled through openings 286 in plate 264 to a space between rotor 256 and stator 252. Motor winding 272 has a cylindrical outer wall and is closely spaced to a cylindrical inner wall of rotor 256. Motor winding 272 may be provided on its cylindrical outer wall with a molecular drag groove 288 for pumping of gas between rotor 256 and stator 252. The upper end of the space between rotor 256 and stator 252 is coupled through openings 290 in plate 266 to a space 292 between end wall 280*b* and plate 266. Gas is then removed from the vacuum pump through a passage 294 in central post 270. Passage 294 is connected to exhaust port 216. The vacuum pump shown in FIG. 2 may optionally be provided with inclined blades 296 at the upper end of rotor 256 for increased pumping capability.

The vacuum pump shown in FIG. 2 thereby provides vacuum pumping through the space between rotor 256 and housing 210, and provides additional vacuum pumping through the space between rotor 256 and stator 252. This embodiment is based on the fact that the rotor 256 rotates relative to the housing 210 and also rotates relative to the stator 252 of the motor. The space between rotor 256 and housing 210 may be provided with any of the types of vacuum pumping stages described above in connection with FIG. 1. Vacuum pumping between rotor 256 and stator 252 preferably utilizes a molecular drag groove in order to maintain a small gap between rotor 256 and stator 252. It will be understood that a variety of different vacuum pump structures may be utilized with the inverted motor configurations shown in FIGS. 2 and 3 and described above.

Figure 3:
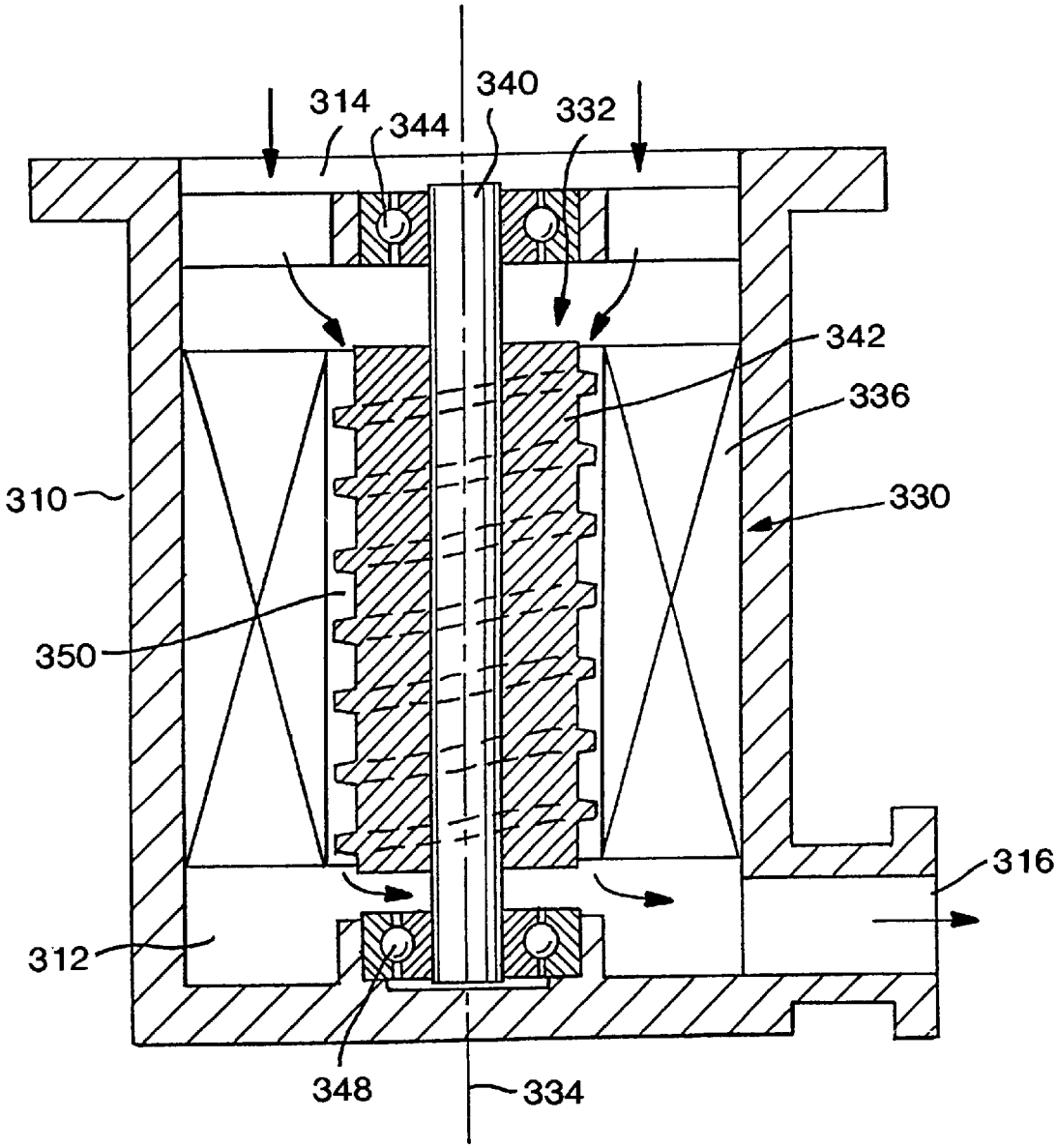
FIG. 3 is a simplified cross-sectional diagram of a vacuum pump in accordance with a third embodiment of the invention.
Figure 4:
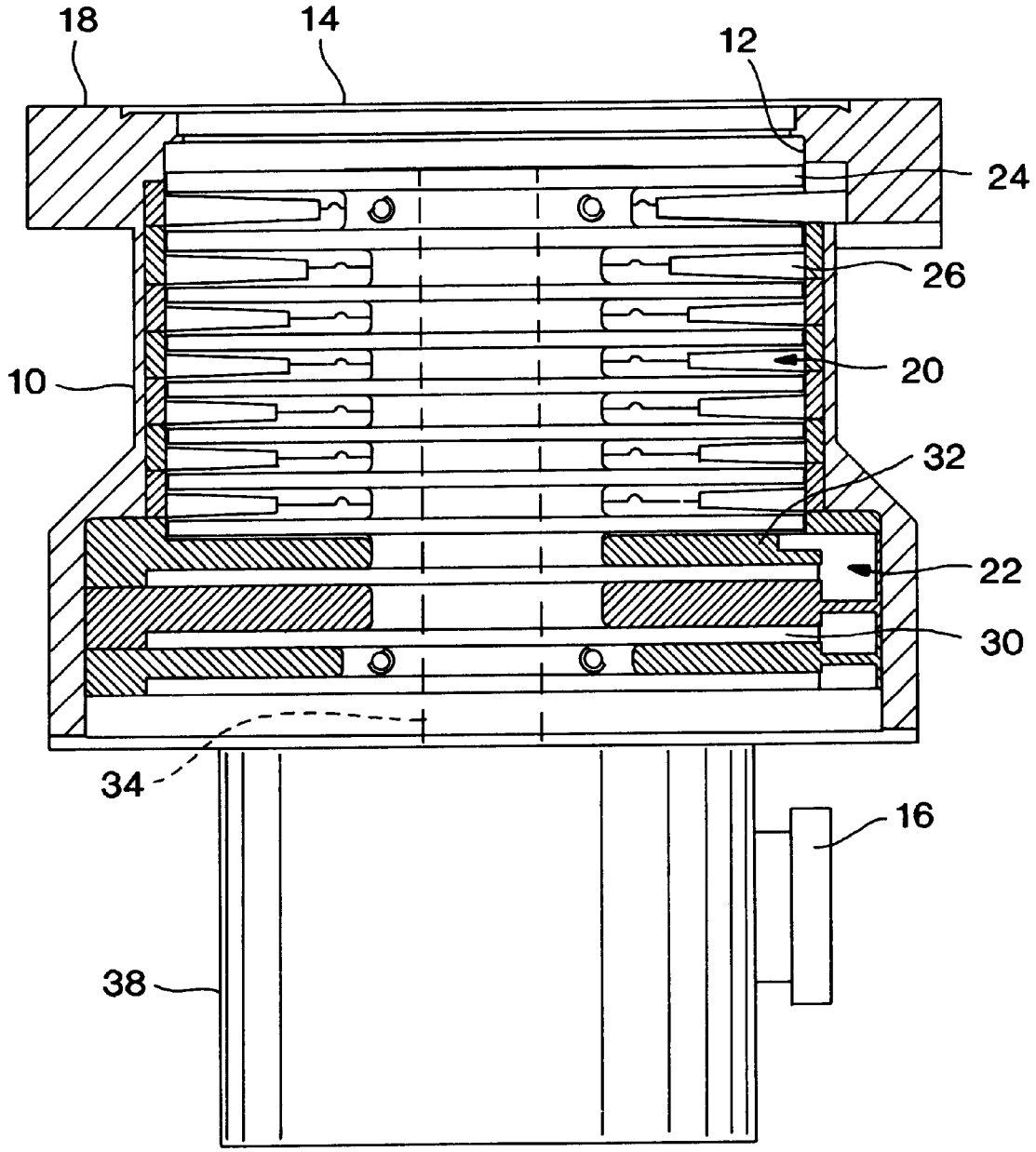
FIG. 4 (PRIOR ART)
FIG. 4 is an elevation view, partly in cross section, of a prior art vacuum pump.

A simplified cross-sectional diagram of a vacuum pump in accordance with a third embodiment of the invention is shown in FIG. 3. A feature employed in the vacuum pump of FIG. 2 is applied to a non-inverted motor configuration. In particular, the rotation of the rotor relative to the stator of the motor is utilized to provide vacuum pumping in the embodiment of FIG. 3. A housing 310 defines an interior chamber 312 having an inlet port 314 and an exhaust port 316. Located within housing 310 is a motor 330 having a conventional non-inverted configuration. Motor 330 includes a rotor 332 positioned on a central axis 334 and a stationary motor winding 336 disposed around rotor 332. Rotor 332 includes a shaft 340 and a magnetic element 342 disposed on shaft 340. Shaft 340 is mounted for rotation in bearings 344 and 348. When motor windings 336 are energized, rotor 332 rotates about axis 334.

Magnetic element 342 has a generally cylindrical outer surface, and motor windings 336 have a generally cylindrical inner surface in close proximity to magnetic element 342. The outer surface of magnetic element 342 is provided with a molecular drag groove 350, which may be helical in shape. When rotor 332 is rotated at high speed, gas is pumped from inlet port 314 through molecular drag groove to exhaust port 316.

In the embodiment of FIG. 3, motor 330 has a non-inverted configuration and functions as a vacuum pump. In the embodiment of FIG. 2, motor 250 has an inverted configuration and functions as a vacuum pump. In most applications, it is likely that the vacuum pump shown in FIG. 3 would be used to supplement another vacuum pump such as, for example, a turbomolecular vacuum pump.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A vacuum pump comprising:

a housing having an inlet port and an exhaust port;

a motor disposed in said housing, said motor comprising a stator disposed on a central axis and a rotor disposed around said stator, wherein said rotor rotates about the central axis when said motor is energized; and one or more vacuum pumping stages disposed in said housing and operationally coupled to said motor for pumping gas from said inlet port to said exhaust port, said one or more vacuum pumping stages comprising at least one outer stage located between said rotor and said housing and at least one inner stage located between said rotor and said stator, said outer stage and said inner stage being connected in series.

2. The vacuum pump as defined in claim 1, wherein each of said vacuum pumping stages comprises a stationary member secured to said housing and a rotating member secured to said rotor.

3. The vacuum pump as defined in claim 1, wherein one or more of said vacuum pumping stages comprises an axial turbomolecular pumping stage, each including a stationary member having inclined blades and a rotating member having inclined blades.

4. The vacuum pump as defined in claim 1, wherein one or more of said vacuum pumping stages comprises a molecular drag stage, each including a stationary member having a tangential flow channel and a rotating member in the form of a disk.

5. The vacuum pump as defined in claim 1, wherein said one or more vacuum pumping stages comprises a rotating member and a stationary member disposed in close proximity, one of said members having a molecular drag groove for pumping gas when said rotating member rotates relative to said stationary member.

6. The vacuum pump as defined in claim 1, wherein said one or more vacuum pumping stages are located between said rotor and said housing.

7. The vacuum pump as defined in claim 1, wherein said inner stage comprises a rotating member coupled to said rotor and a stationary member coupled to said stator, one of said members having a molecular drag groove for pumping gas when said rotating member rotates relative to said stationary member.

8. The vacuum pump as defined in claim 1, wherein said stator comprises a central post having a passage for removing gases pumped by said vacuum pumping stages.

9. The vacuum pump as defined in claim 1, wherein at least part of said motor is positioned within said vacuum pumping stages, wherein said vacuum pumping stages have an annular configuration disposed around said motor.

10. The vacuum pump as defined in claim 1, wherein the stator of said motor comprises a central post having motor windings disposed thereon and wherein the rotor of said motor comprises a cylindrical element disposed around said stator, said cylindrical element having magnetic material disposed in alignment with said motor windings.

* * * * *